United States Patent [19]

Hagemeister

[11] Patent Number: 4,592,106

[45] Date of Patent: Jun. 3, 1986

[54] ANCHOR FOR SECURING THE LOWER END OF A SPRING

[75] Inventor: Robert C. Hagemeister, Boston, Mass.

[73] Assignee: Webster Spring Co. Inc., Oxford, Mass.

[21] Appl. No.: 675,891

[22] Filed: Nov. 28, 1984

[51] Int. Cl.[4] ..... A47C 23/053

[52] U.S. Cl. ..... 5/245; 5/254; 5/263; 24/652

[58] Field of Search ..... 5/263, 245, 254, 265, 5/266, 270, 236 R, 239, 259 R, 259 B, 200 R, 246, 248; 24/343, 652

[56] References Cited

U.S. PATENT DOCUMENTS

| | | | |
|---|---|---|---|
| 1,104,678 | 7/1914 | Knauff | 5/259 B |
| 3,288,503 | 11/1966 | Slominski | 5/259 B |
| 3,633,226 | 1/1972 | Krakauer | 5/263 |
| 3,877,091 | 4/1975 | Jureit et al. | 5/200 R |
| 3,969,793 | 7/1976 | Crosby | 5/259 B |

*Primary Examiner*—Alexander Grosz
*Attorney, Agent, or Firm*—Robert T. Gammons

[57] ABSTRACT

Anchoring means for securing the lower end of a coil to a frame embodying spaced, parallel supports structured to be slidably engaged with upwardly and downwardly-facing shoulders on the supports for longitudinal adjustment of the lower ends of the springs on the supports.

5 Claims, 8 Drawing Figures

ANCHOR FOR SECURING THE LOWER END OF A SPRING

BACKGROUND OF THE INVENTION

Conventionally, spring assemblies comprise a base frame formed of spaced, parallel bars of wood and a top frame comprised of crossing wires. The coils are positioned between the base frame and the top frame with their lower ends secured to the bars and their upper ends secured to the wires of the top frame. Usually, the lower ends of the wires are stapled to the bars, although fastening elements other than staples may be used. If metal bars or plastic bars are used, fasteners other than staples must be used. For example, metal bars and plastic bars can be provided with tongues or tangs struck out of the surfaces of the bars with which the lower ends of the coils can be engaged. This requires that the bars be specially structured to be used for spring assemblies having different numbers of coils and different spacings of coils. It is the purpose of this invention to provide for anchoring the lower ends of springs to a base frame, whether wood, metal or plastic, and at whatever spacing the coils are disposed without having to alter the structure of the base frame and in such a way as to insure vertical alignment of the axis of the coils with respect to the plane of the frame.

SUMMARY OF THE INVENTION

As herein illustrated, the invention comprises anchoring means for securing the lower ends of coil springs to a frame member embodying spaced, parallel supports in the form of bars wherein the bars have upwardly and downwardly-facing sides comrpising a base plate corresponding in width to the transverse width of the bar and in length to an incremental length thereof for sliding engagement with the upwardly-facing side, a pair of longitudinally-spaced eyes on the upwardly-facing side of the base plate centered transversely thereof and means slidably securing the base plate to the bar comprising transversely-spaced shoulders at the lower side of the plate and spaced therefrom for clinching engagement with the downwardly-facing side of the bar.

The invention will now be described in greater detail with reference to the accompanying drawings, wherein.

Figure 1:
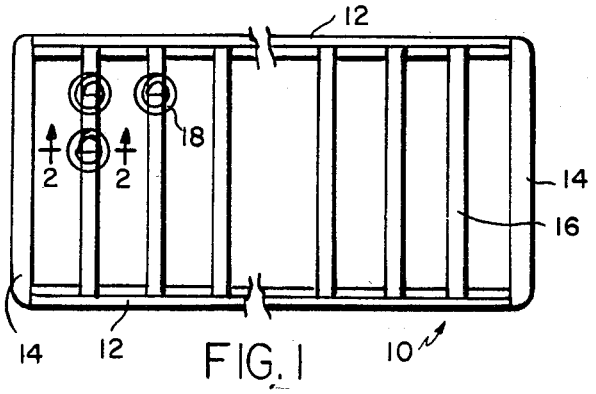
FIG. 1 is a plan view of the base frame of a spring assembly provided with spaced, parallel, longitudinally-spaced, transversely-extending supporting bars to which the lower ends of coil springs are attached.

Referring to the drawings, there is shown a base frame 10 for a spring assembly comprised of rectangularly-disposed, spaced, parallel side members 12—12 and end members 14—14. Between the side members 12—12 and spaced longitudinally of the frame, there are transversely-extending, spaced, parallel supporting bars 16. These supporting bars are provided to support the lower ends of coiled springs 18 which are positioned thereon with their lower ends fastened to the supporting bars by anchoring means which will now be described.

The supporting bars 16 may be of solid cross section as, for example, wooden bars, or may be of U-shaped cross section comprised, for example, of metal or plastic.

Figure 2:
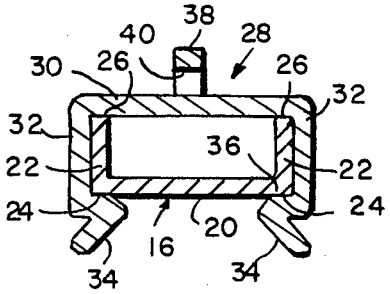
FIG. 2 is an enlarged transverse section of a supporting bar showing anchoring means for attaching the lower ends of the springs to the supporting bar.
Figure 3:
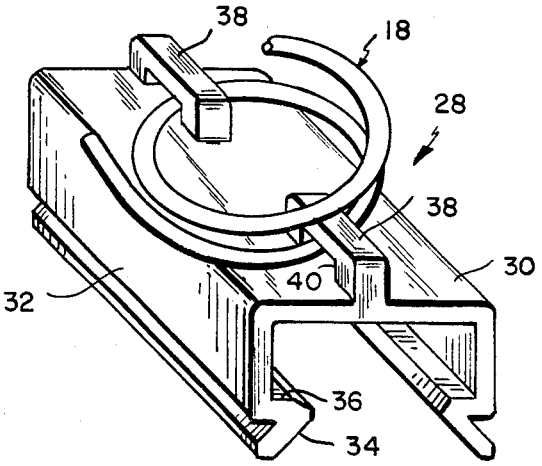
FIG. 3 is a perspective of the anchoring means shown in FIG. 2.
Figure 4:
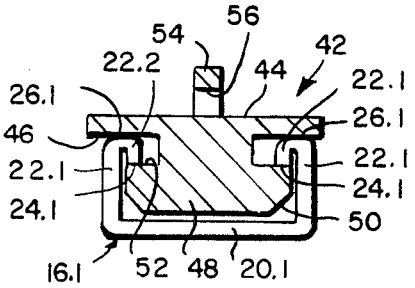
FIG. 4 is a transverse section of an alternative form of supporting bar and anchoring means.
Figure 5:
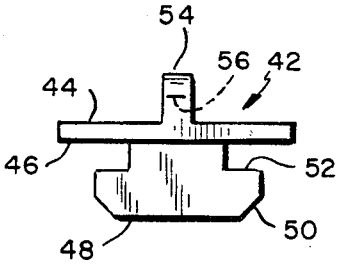
FIG. 5 is an end elevation of the anchoring means shown in FIG. 4.
Figure 6:
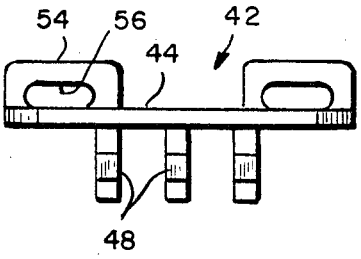
FIG. 6 is a side elevation of the anchoring means shown in FIG. 4.
Figure 7:
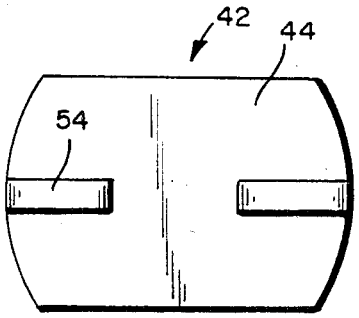
FIG. 7 is a plan view of the anchoring means shown in FIG. 6.
Figure 8:
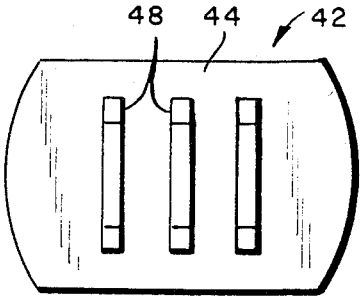
FIG. 8 is a bottom view of the anchoring means shown in FIG. 6.

FIGS. 2 and 3 show one form of anchoring means for securing the lower end of a coiled spring to a bar 16 which is of U-shaped cross section comprising a web 20 and transversely-disposed, spaced, parallel flanges 22—22. The bar 16 defines downwardly-facing surfaces 24—24 and upwardly-facing surfaces 26—26.

The anchoring means 28, FIGS. 2 and 3, provided for attaching the lower ends of coiled springs to the bar 16, as shown in FIGS. 2 and 3, comprises a channel member embodying a base plate 30 corresponding in width to the transverse width of the support bar 20 and in length to an incremental length of the bar for engagement with the upwardly-facing surfaces 26—26 of the bar and transversely-spaced flanges 32—32 for sliding engagement with the sides of the bar, thus to enable the anchoring means to be moved lengthwise of the bar. At the lower ends of the flanges 32—32, there are latch members 34—34 provided with upwardly-facing surfaces 36—36 for engagement with the downwardly-facing surfaces 24—24.

The latch members 34—34 slidingly secure the anchoring means 28 to the bar 16.

At the upwardly-facing side of the base plate 30, there are longitudinally-spaced eyes 38—38 defining openings 40—40 through which the lower end of a coiled spring 18 can be threaded to secure the lower end of the coil spring to the anchoring means.

The anchoring means may be comprised of metal or plastic, and is sufficiently elastic so that it may be snapped onto the bar 16 and will be retained thereon by the elasticity sufficiently firmly so that it will not become detached except by forcibly spreading the latching elements 34—34 away from each other. The anchoring means, however, can be slid along the bars 16 to insure that the lower end of the coil spring is vertically below the upper attached end of the coil spring which is attached in conventional fashion to the grid frame, not shown.

As can be readily seen, the anchoring means 28 of FIGS. 2 and 3 can be employed to attach the lower ends of coil springs to not only the U-shaped bar 16 shown in FIG. 2, but also to a bar of solid cross section as, for example, a wooden bar of rectangular cross section.

An alternative form of anchoring means 42 is shown in FIGS. 4 to 8 inclusive for attaching the lower ends of springs to a support bar 16.1 of U-shaped cross section comprising a web 20.1 and spaced, parallel sides 22.1—22.1, at the upper ends 22.2—22.2 of which are inwardly and downwardly bent flanges so as to define upwardly-facing surfaces 26.1—26.1 and downwardly-facing surfaces 24.1—24.1.

The anchoring means 42 comprises a plate 44 of a transverse width at least as wide as the bar 16.1 having downwardly-facing surfaces 46—46 for sliding engagement with the surfaces 26.1—26.1. At the lower side of the plate 44, there are longitudinally-spaced, vertically-disposed anchoring elements 48 provided with upwardly-facing surfaces 52—52 for sliding engagement with the downwardly-facing surfaces 24.1—24.1 spaced from the underside of the plate 44 a distance corresponding to the depth of the flanges 22.2—22.2. The lower portions of the anchoring means 48 are beveled as at 50—50 to enable forcing them downwardly between the flanges 22.2—22.2 of the bar so as to become engaged with the downwardly-facing surfaces 24.1—24.1. The anchoring means 42 may be comprised of metal or plastic. On the upwardly-facing side of the plate 44, there are eyes 54—54 defining openings 56—56 for receiving the lower ends of the coils. Like the anchoring means disclosed in FIGS. 2 and 3, the anchoring means 42 is firmly locked to the bar, but can be slid along the length of the bar to adjust the lower end of the spring attached thereto relative to its upper end.

The anchoring means 28 and 42 are relatively simple and inexpensive to manufacture, can be easily assembled to the base frame and the lower ends of the coil springs can be easily attached hereto without requiring tools for this purpose.

It should be understood that the present disclosure is for the purpose of illustration only and includes all modifications or improvements which fall within the scope of the appended claims.

What is claimed is:

1. An anchor, for securing the lower end of a coil spring to a frame member embodying spaced, parallel supports, said supports having vertically-spaced, horizontal, upwardly and downwardly-facing sides, said anchor comprising a base plate corresponding in transverse width to the support and in length to an incremental portion thereof for sliding engagement with the upwardly-facing side of the support, a pair of longitudinally-spaced lugs on the upwardly-facing side of the base plate and means for slidably securing the base plate to the support comprising transversely-spaced flanges at the opposite edges of the base plate depending from the downwardly-facing side thereof for engagement with the sides of the support, said flanges being yieldably resistant to displacement and latch elements at the lower edges of the flanges engaged with the downwardly-facing side of the support.

2. An anchor structure according to claim 1 wherein said latch element defines inwardly-extending horizontal ribs engaged with the downwardly-facing side of the support.

3. An anchor structure according to claim 2 wherein there are downwardly-extending, outwardly-inclined lips along the inner edges of the ribs.

4. An anchor structure according to claim 1 wherein the supports are of rectangular cross section.

5. An anchor structure according to claim 1 wherein the supports are channel members of rectangular cross section and the upwardly and downwardly-facing sides are defined by the edges of the channel and the back of the channel.

* * * * *